US011536546B1

(12) United States Patent
Kushner

(10) Patent No.: US 11,536,546 B1
(45) Date of Patent: Dec. 27, 2022

(54) PROJECTILE FOR A LAUNCHING DEVICE

(71) Applicant: UT Brands LLC, San Diego, CA (US)

(72) Inventor: Robert Kushner, San Diego, CA (US)

(73) Assignee: UT BRANDS LLC, San Diego, CA (US)

( * ) Notice: Subject to any disclaimer, the term of this patent is extended or adjusted under 35 U.S.C. 154(b) by 0 days.

(21) Appl. No.: 17/538,793

(22) Filed: Nov. 30, 2021

(51) Int. Cl.
*F42B 6/06* (2006.01)

(52) U.S. Cl.
CPC ..... *F42B 6/06* (2013.01)

(58) Field of Classification Search
CPC ..... F42B 6/003; F42B 6/06; F42B 6/04
See application file for complete search history.

(56) References Cited

U.S. PATENT DOCUMENTS 1,162,200 A * 11/1915 Winans ..... F42B 6/06 473/585
3,384,373 A * 5/1968 Siegler ..... F42B 6/003 473/578
4,114,883 A * 9/1978 Fuscone ..... F42B 6/003 473/586
5,897,449 A * 4/1999 Roberts ..... F42B 10/26 473/586
6,904,901 B2 6/2005 Mitchell
7,758,457 B2 * 7/2010 Marshall ..... F42B 6/06 473/586
7,892,119 B2 * 2/2011 Marshall ..... F42B 6/06 473/586
8,012,049 B1 9/2011 Walterscheid
8,087,405 B2 1/2012 Mitchell
8,348,789 B1 1/2013 Walterscheid
8,382,616 B2 * 2/2013 Marshall ..... F41B 5/1446 473/578
8,485,168 B2 7/2013 Walterscheid
8,662,060 B2 3/2014 Walterscheid et al.
8,689,773 B2 4/2014 Walterscheid et al.
8,991,373 B2 3/2015 Cummings
9,091,514 B1 7/2015 Cummings
9,097,483 B2 8/2015 Walterscheid
9,151,566 B2 10/2015 Cummings
9,239,205 B2 1/2016 Cummings
9,341,448 B2 5/2016 Cummings
9,410,776 B1 * 8/2016 Hill ..... F42B 6/06
9,518,805 B1 * 12/2016 Daniels ..... F42B 6/06
9,522,321 B2 12/2016 Cummings
(Continued)

*Primary Examiner* — John A Ricci
(74) *Attorney, Agent, or Firm* — Umberg Zipser LLP

(57) ABSTRACT

A projectile is provided. The projectile includes a shaft having a forward end and a rearward end. The projectile further includes a first fin component and a second fin component disposed proximate to the rearward end. At least one of the first fin component and the second fin component engages the other of the first fin component and the second fin component for securing the first fin component and the second fin component together. Another projectile includes a fin mount coupled to the rearward end of the shaft. The fin mount includes an extension extending away from the shaft with the extension defining a bore extending through the extension transverse to the shaft. The extension has a substantially cylindrical configuration and the aperture is adapted to receive a pin of a launching device for releasably securing the projectile to the launching device.

19 Claims, 10 Drawing Sheets

(56) References Cited

U.S. PATENT DOCUMENTS

| | | | | |
|---|---|---|---|---|
| 9,903,681 | B2 | 2/2018 | Walterscheid et al. | |
| 2007/0173359 | A1* | 7/2007 | Mowery | F42B 6/06 473/585 |
| 2010/0167849 | A1* | 7/2010 | Malucelli | F41B 5/1446 473/586 |

* cited by examiner

PROJECTILE FOR A LAUNCHING DEVICE

FIELD OF THE INVENTION

The present disclosure generally relates to projectiles for launching devices.

BACKGROUND

Projectiles are generally defined as devices that fly through the air. In most cases, the projectile is launched into its flying state using a launcher. A shafted projectile is a type of projectile that has a shaft along with one or more fins for guiding the projectile through the air.

Conventional projectiles rely on a variety of methods for securing the fins to their projectiles. For example, some projectiles use adhesives, such as tape or glue, to couple the fins to the projectile. However, these adhesives are prone to failure after a short period of use. On the other hand, other projectiles use a combination of fasteners to couple each of the fins to the projectile. While these fasteners are more durable than adhesives, the fasteners require more time and materials for assembly and add undesirable weight to the projectile.

For launching, some conventional projectiles rely on one or more hooks near the head of projectile to couple to projectile to the launcher. Other projectiles must be retained in an energized position by the user until launch of the projectile is desired. Unfortunately, these manners of coupling the projectile to the launchers require specific types of launchers to be utilized (e.g., bow launchers) and thus are not compatible with cannon launchers.

Accordingly, there remains an opportunity for improved projectiles for launching devices.

BRIEF SUMMARY OF THE INVENTION

A projectile for a launching device in provided. The projectile includes a shaft having a forward end and a rearward end. The shaft extends between the forward end and the rearward end. The projectile further includes a first fin component disposed proximate to the rearward end with the first fin component extending transverse to the shaft to opposing first fin distal ends. The projectile further includes a second fin component disposed proximate to the rearward end with the second fin component extending transverse to the shaft to opposing second fin distal ends. At least one of the first fin component and the second fin component engages the other of the first fin component and the second fin component for securing the first fin component and the second fin component together.

Another projectile for a launching device is provided. The projectile includes a shaft having a forward end and a rearward end. The shaft extends between the forward end and the rearward end. The projectile further includes a fin mount coupled to the rearward end of the shaft. The fin mount includes an extension extending away from the shaft with the extension defining a bore extending through the extension transverse to the shaft. The extension has a substantially cylindrical configuration and the aperture is adapted to receive a pin of a launching device for releasably securing the projectile to the launching device.

Another projectile for a launching device is provided. The projectile includes a shaft having a forward end and a rearward end. The shaft extends between the forward end and the rearward end. The projectile further includes a fin mount coupled to the rearward end of the shaft. The fin mount defines a first recess, a second recess, a third recess, and a fourth recess. The projectile further includes a first fin at least partially disposed within the first recess. The projectile further includes a second fin at least partially disposed within the second recess. The projectile further includes a third fin at least partially disposed within the third recess. The projectile further includes a fourth fin at least partially disposed within the fourth recess.

DETAILED DESCRIPTION

Figure 1:
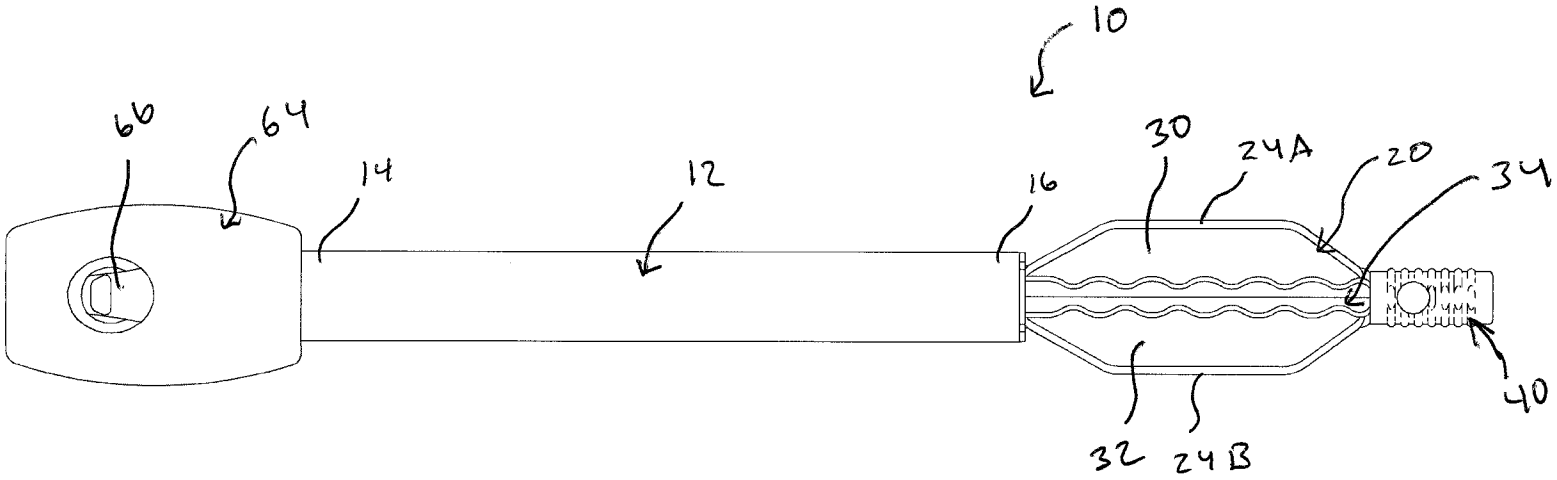
FIG. 1 is a top view illustrating non-limiting embodiments of a projectile.
Figure 2:
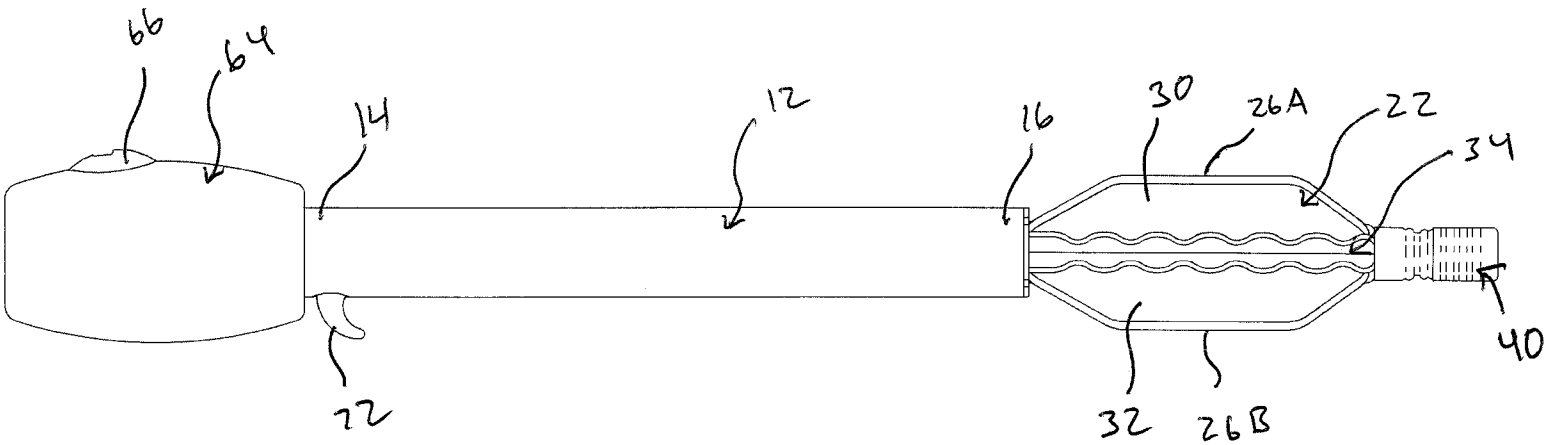
FIG. 2 is a side view illustrating non-limiting embodiments of the projectile of FIG. 1.
Figure 3:
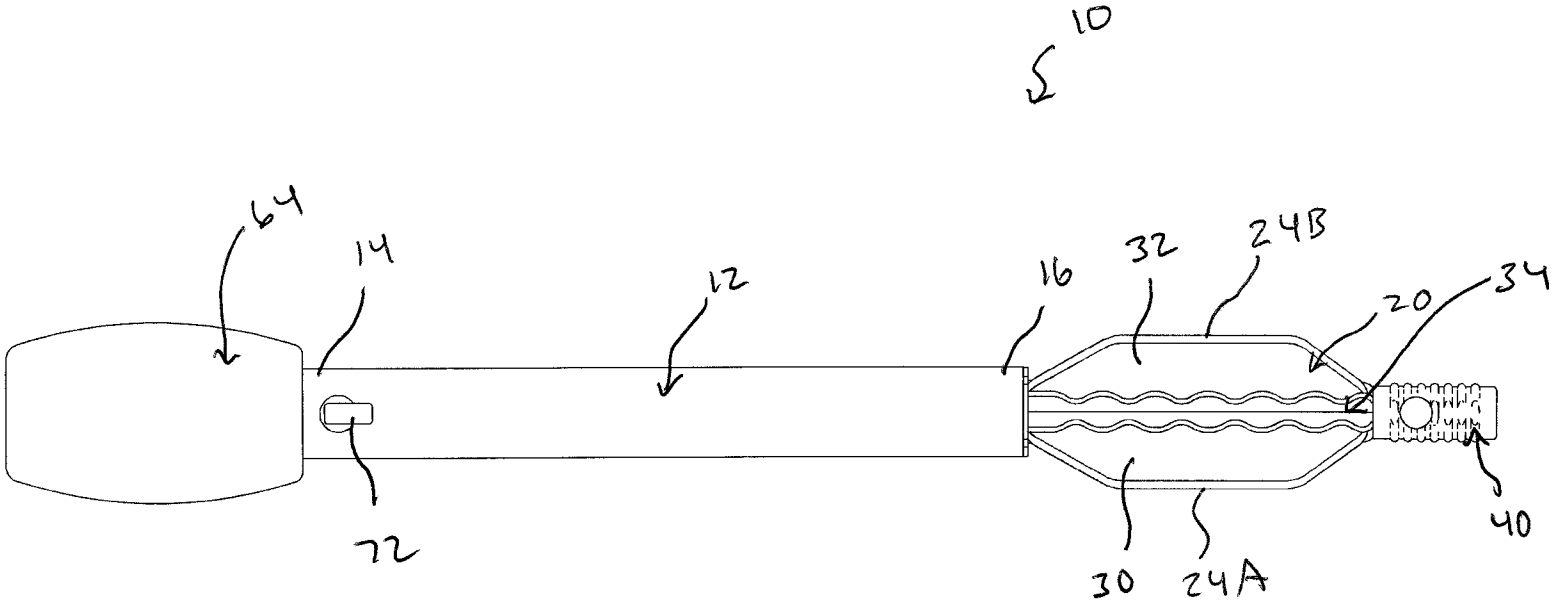
FIG. 3 is a bottom view illustrating non-limiting embodiments of the projectile of FIG. 1.
Figure 4:
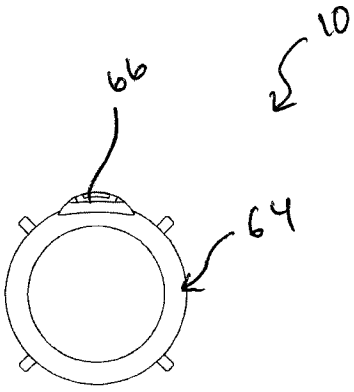
FIG. 4 is a front view illustrating non-limiting embodiments of the projectile of FIG. 1.
Figure 5:
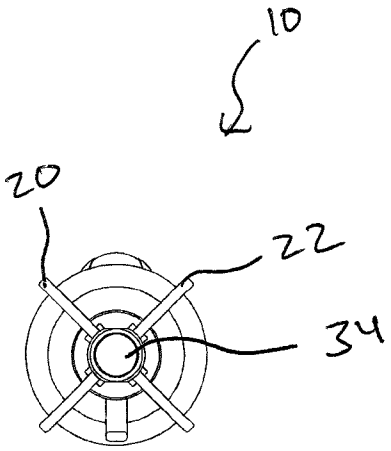
FIG. 5 is a rear view illustrating non-limiting embodiments of the projectile of FIG. 1.
Figure 6:
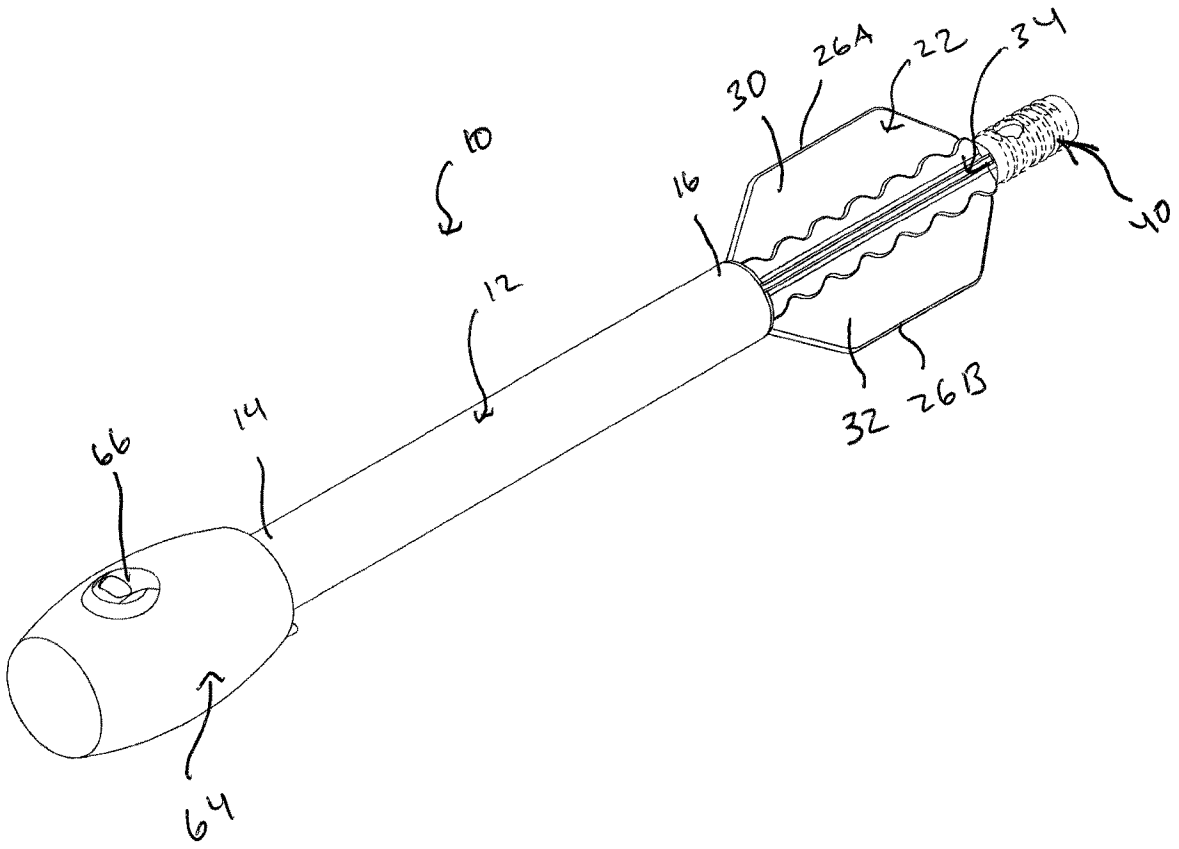
FIG. 6 is a perspective view illustrating non-limiting embodiments of the projectile of FIG. 1.

Except in the examples, or where otherwise expressly indicated, all numerical quantities in this description indicating amounts of material or conditions of reaction and/or use are to be understood as modified by the word "about" in describing the broadest scope of the disclosure. In various embodiments, the terms "about" and "approximately", when referring to a specified, measurable value (such as a parameter, an amount, a temporal duration, and the like), is meant to encompass the specified value and variations of and from the specified value, such as variations of +/−10% or less, alternatively +/−5% or less, alternatively +/−1% or less, alternatively +/−0.1% or less of and from the specified value, insofar as such variations are appropriate to perform in the disclosed embodiments. Thus the value to which the modifier "about" or "approximately" refers is itself also specifically disclosed.

Practice within the numerical limits stated is generally preferred. Also, unless expressly stated to the contrary: percent, "parts of," and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

It must also be noted that, as used in the specification and the appended claims, the singular form "a," "an," and "the" comprise plural referents unless the context clearly indicates otherwise. For example, reference to a component in the singular is intended to comprise a plurality of components.

As used herein, an "embodiment" means that a particular feature, structure or characteristic is included in at least one or more manifestations, examples, or implementations of this invention. Furthermore, the particular features, structures or characteristics may be combined in any suitable manner, as would be apparent to a person skilled in the art. Combinations of features of different embodiments are all meant to be within the scope of the invention, without the need for explicitly describing every possible permutation by example. Thus, any of the claimed embodiments can be used in any combination.

As used herein, the term "weight percent" (and thus the associated abbreviation "wt. %") typically refers to a percent by weight expressed in terms of a weight of dry matter. As such, it is to be appreciated that a wt. % can be calculated on a basis of a total weight of a composition, or calculated from a ratio between two or more components/parts of a mixture (e.g., a total weight of dry matter).

As used herein, the term "substantially" refers to the complete, or nearly complete, extent or degree of an action, characteristic, property, state, structure, item, or result. As an arbitrary example, an object that is "substantially" enclosed would mean that the object is either completely enclosed or nearly completely enclosed so as to have the same overall result as if the object were completely enclosed.

The drawings are semi-diagrammatic and not to scale and, particularly, some of the dimensions are for the clarity of presentation and are shown exaggerated in the drawings. Similarly, although the views in the drawings for ease of description generally show similar orientations, this depiction in the drawings is arbitrary. Generally, composite articles can be operated in any orientation. As used herein, it will be understood that when a first element or layer is referred to as being "over," "overlying," "under," or "underlying" a second element or layer, the first element or layer may be directly on the second element or layer, or intervening elements or layers may be present where a straight line can be drawn through and between features in overlying relationship. When a first element or layer is referred to as being "on" a second element or layer, the first element or layer is directly on and in contact with the second element or layer. Further, spatially relative terms, such as "upper," "over," "lower," "under," and the like, may be used herein for ease of description to describe one element or feature's relationship to another element(s) or feature(s) as illustrated in the figures. It will be understood that the spatially relative terms are intended to encompass different orientations of the composite article in use or operation in addition to the orientation depicted in the figures. For example, if the composite article in the figures is turned over, elements described as being "under" other elements or features would then be oriented "above" the other elements or features. Thus, the exemplary term "under" can encompass either an orientation of above or below. The composite article may be otherwise oriented (rotated 90 degrees or at other orientations) and the spatially relative descriptors used herein may likewise be interpreted accordingly.

Throughout this disclosure, where publications are referenced, the disclosures of these publications in their entireties are hereby incorporated by reference into this disclosure to more fully describe the state of the art to which this disclosure pertains.

The following detailed description is merely illustrative in nature and is not intended to limit the embodiments of the subject matter or the application and uses of such embodiments. Furthermore, there is no intention to be bound by any expressed or implied theory presented in the preceding technical field, background, brief summary or the following detailed description.

FIGS. 1-9 are various views illustrating non-limiting embodiments of a projectile 10 for a launching device. The projectile 10 includes a shaft 12 having a forward end 14 and a rearward end 16 with the shaft 12 extending therebetween. The shaft 12 may be any shaft known in the art suitable for projectiles. Non-limiting examples include tube shafts, rod shafts, mesh shafts, and combinations thereof. In certain embodiments, the shaft 12 is a tube shaft. In these and other embodiments, the shaft 12 defines a void 18 (see FIGS. 7 and 8) extending through the rearward end 16 of the shaft 12.

The shaft 12 may be formed using any process known in the art. Exemplary processes include, but are not limited to, molding (e.g., blow molding, compression molding, and/or injection molding), ultrasonics, and the like. The shaft 12 may be formed from or include a foam, a plastic, rubber, a lignocellulosic material, or combinations thereof. Non-limiting examples of suitable materials used to form the shaft 12 include polyurethane, ethylene vinyl acetone (EVA), thermal plastic (TPR), polyvinyl chloride (PVC), acrylonitrile butadiene styrene (ABS), nylon, polyethylene terephthalate (PET), nylon, thermoplastic elastomer (TPE), and combinations thereof.

Figure 7:
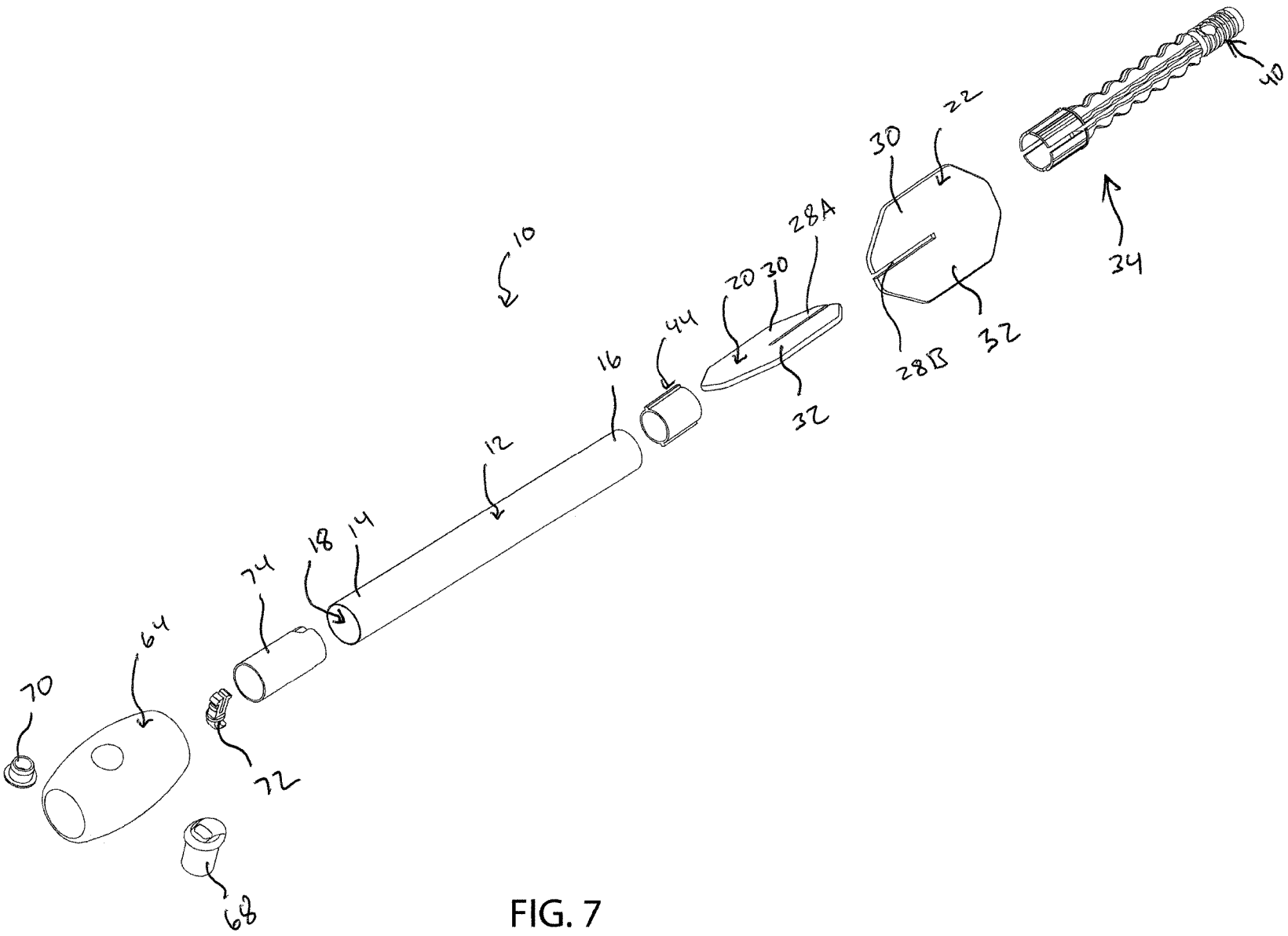
FIG. 7 is an exploded perspective view illustrating non-limiting embodiments of the projectile of FIG. 1.
Figure 8:
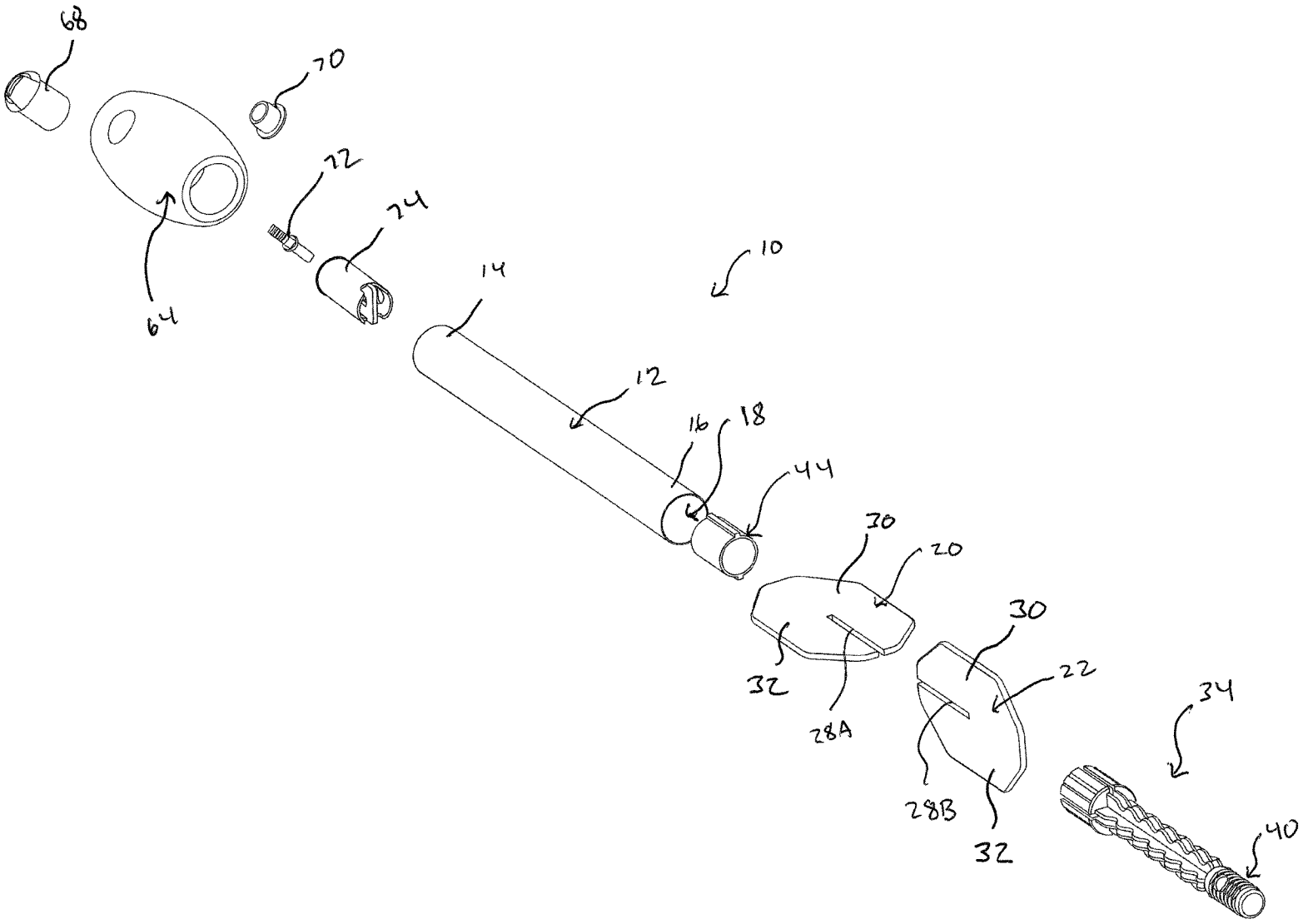
FIG. 8 is another exploded perspective view illustrating non-limiting embodiments of the projectile of FIG. 1.

With particular reference to FIGS. 7 and 8, the projectile 10 further includes a first fin component 20 and a second fin component 22 disposed proximate to the rearward end 16 of the shaft 12. The first fin component 20 extends transverse to the shaft 12 to opposing first fin distal ends 24A, 24B. Likewise, the second fin component 22 extends transverse to the shaft 12 to opposing second fin distal ends 26A, 26B. At least one of the first fin component 20 and the second fin component 22 engages the other of the first fin component 20 and the second fin component 22 for securing the first fin component 20 and the second fin component 22 together.

The first fin component 20 and/or the second fin component 22 may be formed using any process known in the art. Exemplary processes include, but are not limited to, molding (e.g., blow molding, compression molding, and/or injection molding), ultrasonics, and the like. The first fin component 20 and/or the second fin component 22 may be formed from or include a foam, a plastic, rubber, a lignocellulosic material, or combinations thereof. Non-limiting examples of suitable materials used to form the first fin component 20 and/or the second fin component 22 include polyurethane, ethylene vinyl acetone (EVA), thermal plastic (TPR), polyvinyl chloride (PVC), acrylonitrile butadiene styrene (ABS), nylon, polyethylene terephthalate (PET), nylon, thermoplastic elastomer (TPE), and combinations thereof.

In various embodiments, at least one of the first fin component 20 and the second fin component 22 defines a slot 28 adapted to receive the other of the first fin component 20 and the second fin component 22. The term "received" as utilized herein means that at least a portion of one of the first fin component 20 and the second fin component 22 is disposed within the slot.

In exemplary embodiments, the first fin component 20 defines a first fin slot 28A and the second fin component 22 defines a second fin slot 28B. The first fin slot 28A and the second fin slot 28B cooperate to secure the first fin component 20 and the second fin component 22 together. In these and other embodiments, the first fin slot 28A and the second fin slot 28B face each other. Moreover, in these and other embodiments, the first fin component 20 and the second fin component 22 bisect each other.

The first fin component 20 has a first portion 30 and a second portion 32 defined by the second fin component 22 with the first portion 30 and the second portion 32 extending transverse to the shaft 12 to the opposing first fin distal ends 24A, 24B. Likewise, the second fin component 22 has a first portion 30 and a second portion 32 defined by the first fin component 20 with the first portion 30 and the second portion 32 extending transverse to the shaft 12 to the opposing second fin distal ends 26A, 26B. In exemplary embodiments, the first fin distal ends 24A, 24B and the second fin distal ends 26A, 26B are substantially equidistant from one another.

The projectile 10 may further include a fin mount 34 disposed proximate to the rearward end 16 of the shaft 12 and adjacent to the first fin component 20 and the second fin component 22. The fin mount 34 may cooperate with the shaft 12 to secure the first fin component 20 and the second fin component 22 to the shaft 12. In exemplary embodiments, the fin mount 34 is received by, or engages, the void 18 to couple the fin mount 34 to the shaft 12.

The fin mount 34 may be formed using any process known in the art. Exemplary processes include, but are not limited to, molding (e.g., blow molding, compression molding, and/or injection molding), ultrasonics, and the like. The fin mount 34 may be formed from or include a foam, a plastic, rubber, a lignocellulosic material, or combinations thereof. Non-limiting examples of suitable materials used to form the fin mount 34 include polyurethane, ethylene vinyl acetone (EVA), thermal plastic (TPR), polyvinyl chloride (PVC), acrylonitrile butadiene styrene (ABS), nylon, polyethylene terephthalate (PET), nylon, thermoplastic elastomer (TPE), and combinations thereof.

Figure 9:
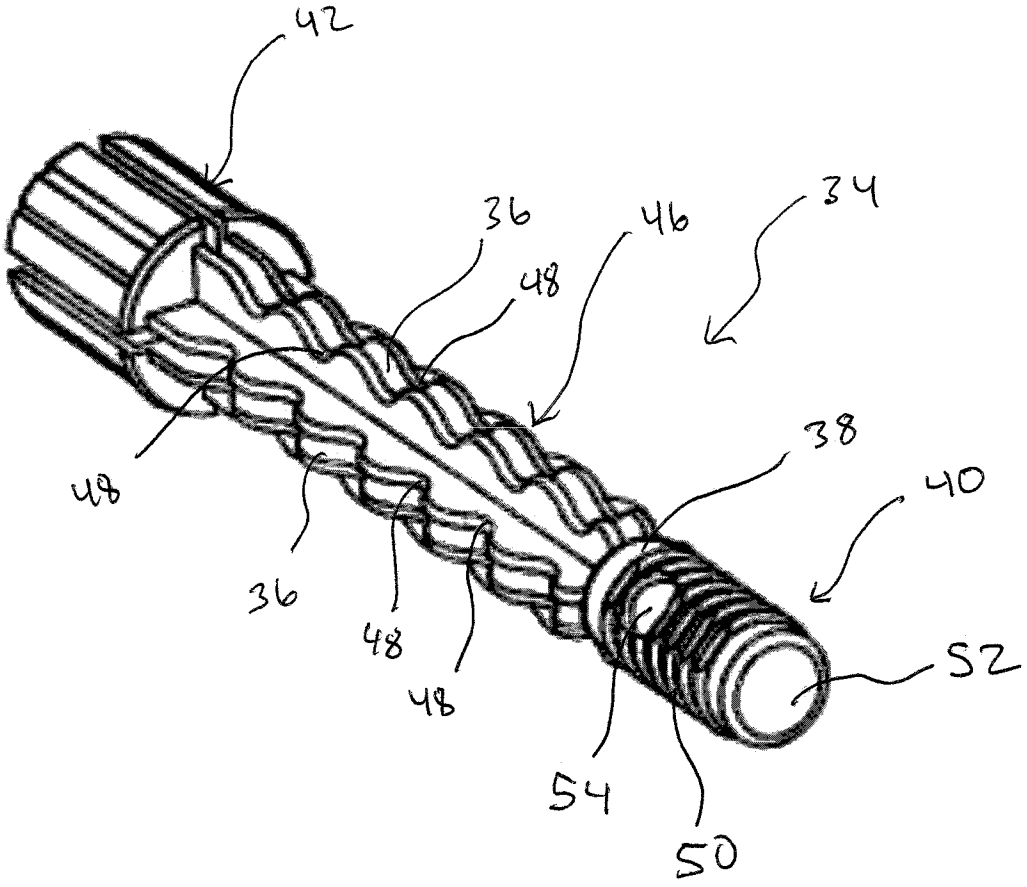
FIG. 9 is a perspective view illustrating non-limiting embodiments of a fin mount for the projectile of FIG. 1.

With particular reference to FIG. 9, the fin mount 34 may define a plurality of recesses 36 with each recess receiving one of the first portion 30 of the first fin component 20, the second portion 32 of the first fin component 20, the first portion 30 of the second fin component 22, and the second portion 32 of the second fin component 22. In various embodiments, the fin mount 34 includes an abutment 38 disposed adjacent to the plurality of recesses 36 for preventing the first fin component 20 and the second fin component 22 from moving laterally away from the shaft 12 thereby securing the first fin component 20 and the second fin component 22 to the projectile 10.

In certain embodiments, the fin mount 34 further includes an extension 40 extending away from the shaft 12, a base 42 disposed within the void 18 of the shaft 12 to couple the fin mount 34 to the shaft 12, and a body disposed between the base 42 and the extension 40. A collar 44 may be disposed between the base 42 and the shaft 12 for securing the base 42 within the void 18 of the shaft 12. The body 46 may define a plurality of receding portions 48 proximate the plurality of recesses 36 for reducing weight of the projectile 10.

At least one of the first fin component 20 and the second fin component 22 may be disposed between the shaft 12 and the extension 40. In particular, in certain embodiments, the base 42 and the body 46 define the plurality of recesses 36 with each recess receiving one of the first portion of the first fin component 20, the second portion of the first fin component 20, the first portion of the second fin component 22, or the second portion of the second fin component 22.

The extension 40 may have a generally cylindrical configuration. However, it is to be appreciated that the extension 40 may have any configuration known in the art. The extension 40 may be substantially rigid. The extension 40 may include a ribbing 50 disposed about the extension 40 for improving manipulation of the projectile 10 by the user. The extension 40 may define a bore 52 extending away from the shaft 12 for reducing weight of the projectile 10.

The extension 40 may define an aperture 54 extending therethrough transverse to the shaft 12. The aperture may be adapted to receive a pin of a launching device for releasably securing the projectile 10 to the launching device. The aperture 54 may have a generally cylindrical configuration. In certain embodiments, the aperture 54 extends through the extension 40 perpendicular to the shaft 12. The aperture 54 may have a diameter of from about 50 millimeters (mm) to about 1 mm, from about 25 mm to about 3 mm, or from about 10 mm to about 5 mm.

Figure 10:
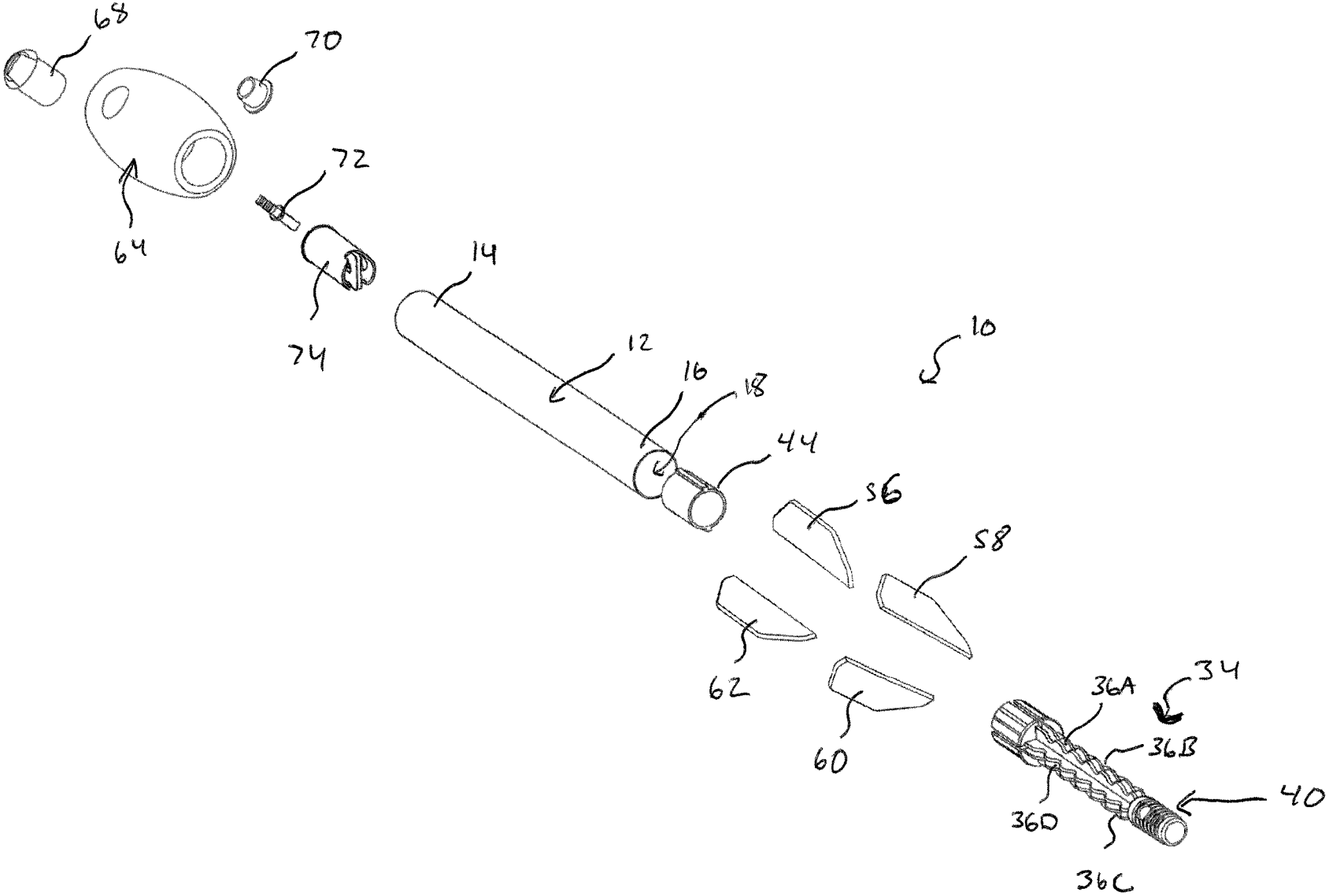
FIG. 10 is an exploded perspective view illustrating non-limiting embodiments of another projectile.

FIG. 10 is an exploded perspective view illustrating another non-limiting embodiment of the projectile 10 for a launching device. Instead of including fin components 20, 22, the projectile 10 of this embodiment includes four separate fins disposed in four recesses of the fin mount 34. In particular, the fin mount 34 defines a first recess 36A, a second recess 36B, a third recess 36C, and a fourth recess 36D. In these and other embodiments, a first fin 56 is at least partially disposed within the first recess 36A, a second fin 58 is at least partially disposed within the second recess 36B. a third fin 60 is at least partially disposed within the third recess 36C, and a fourth fin 62 is at least partially disposed within the fourth recess 36D.

The fin mount 34 may apply a compressive force to the first fin 56, the second fin 58, the third fin 60, and the fourth fin 62 for securing the first fin 56, the second fin 58, the third fin 60, and the fourth fin 62 to the projectile. Alternative to, or in combination with, the fin mount 34 may further include an adhesive disposed between the fin mount 34 and the each of the first fin 56, the second fin 58, the third fin 60, and the fourth fin 62 for securing the first fin 56, the second fin 58, the third fin 60, and the fourth fin 62 to the projectile 10. It is to be appreciated that any adhesive known in the art compatible with projectiles may be utilized, such as curable adhesives, tapes, pressure-sensitive adhesives, etc.

Referring now to FIGS. 1-10, the projectile 10 further includes a head 64 coupled to the forward end 14 of the shaft 12. The head 64 can be formed as a single component or as a combination of multiple components coupled together to form the head 64. The head 64 may be formed using any process known in the art. Exemplary processes include, but are not limited to, molding (e.g., blow molding, compression molding, and/or injection molding), ultrasonics, and the like. The head 64 may be formed from or include a foam, a plastic, rubber, a lignocellulosic material, or combinations thereof. Non-limiting examples of suitable materials used to form the head 64 include polyurethane, ethylene vinyl acetone (EVA), thermal plastic (TPR), polyvinyl chloride (PVC), acrylonitrile butadiene styrene (ABS), nylon, polyethylene terephthalate (PET), nylon, thermoplastic elastomer (TPE), and combinations thereof.

In various embodiments, the head 64 includes a whistle 66 (e.g., a vented slit through which air passes to make a whistling sound). The whistle 66 may include an exterior portion 68 and an interior portion 70 that are configured to engage each other about the head 64 for securing the whistle 66 to the head 64. The whistle 66 may be formed using any process known in the art. Exemplary processes include, but are not limited to, molding (e.g., blow molding, compression molding, and/or injection molding), ultrasonics, and the like. The whistle 66 may be formed from or include a foam, a plastic, rubber, a lignocellulosic material, or combinations thereof. Non-limiting examples of suitable materials used to form the whistle 66 include polyurethane, ethylene vinyl acetone (EVA), thermal plastic (TPR), polyvinyl chloride (PVC), acrylonitrile butadiene styrene (ABS), nylon, polyethylene terephthalate (PET), nylon, thermoplastic elastomer (TPE), and combinations thereof.

In various embodiments, the projectile 10 may further include at least one hook 72 for engaging a projectile launcher. The hook 72 may be disposed in or on any part of the projectile so long as the hook 72 can engage a projectile launcher. In certain embodiments, the hook 72 is coupled to the shaft 12 by a hook mount 74 that engages both the shaft 12 and head 64 for securing the hook 72 to the projectile 10. The hook 72 may be formed using any process known in the art. Exemplary processes include, but are not limited to, molding (e.g., blow molding, compression molding, and/or injection molding), ultrasonics, and the like. The hook 72 may be formed from or include a foam, a plastic, rubber, a lignocellulosic material, or combinations thereof. Non-limiting examples of suitable materials used to form the hook 72 include polyurethane, ethylene vinyl acetone (EVA), thermal plastic (TPR), polyvinyl chloride (PVC), acrylonitrile butadiene styrene (ABS), nylon, polyethylene terephthalate (PET), nylon, thermoplastic elastomer (TPE), and combinations thereof.

It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

Further, any ranges and subranges relied upon in describing various embodiments of the present invention independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present invention, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

The present invention has been described herein in an illustrative manner, and it is to be understood that the terminology which has been used is intended to be in the nature of words of description rather than of limitation. Many modifications and variations of the present invention are possible in light of the above teachings. The present invention may be practiced otherwise than as specifically described within the scope of the appended claims. The subject matter of all combinations of independent and dependent claims, both single and multiple dependent, is herein expressly contemplated.

What is claimed is:

1. A projectile for a launching device, comprising:

a shaft having a forward end and a rearward end with the shaft extending therebetween;

a hook coupled to the shaft, wherein the hook extends transversely relative to the shaft and is curved at an angle toward the rearward end of the shaft for engaging a launching device;

a first fin component disposed proximate to the rearward end with the first fin component extending transverse to the shaft to opposing first fin distal ends; and a second fin component disposed proximate to the rearward end with the second fin component extending transverse to the shaft to opposing second fin distal ends;

wherein at least one of the first fin component and the second fin component engages the other of the first fin component and the second fin component for securing the first fin component and the second fin component together.

2. The projectile of claim 1, wherein at least one of the first fin component and the second fin component defines a slot to receive the other of the first fin component and the second fin component.

3. The projectile of claim 2, wherein the first fin component defines a first fin slot and the second fin component defines a second fin slot, and wherein the first fin slot and the second fin slot cooperate to secure the first fin component and the second fin component together.

4. The projectile of claim 3, wherein the first fin slot and the second fin slot face each other.

5. The projectile of claim 4, wherein the first fin component and the second fin component bisect each other.

6. The projectile of claim 1 further comprising a fin mount disposed proximate to the rearward end of the shaft and adjacent to the first fin component and the second fin component, wherein the fin mount cooperates with the shaft to secure the first fin component and the second fin component to the shaft.

7. The projectile of claim 6, wherein:

the first fin component has a first portion and a second portion defined by the second fin component with the first portion and the second portion extending transverse to the shaft to the opposing first fin distal ends; and the second fin component has a first portion and a second portion defined by the first fin component with the first portion and the second portion extending transverse to the shaft to the opposing second fin distal ends.

8. The projectile of claim 7, wherein the fin mount defines a plurality of recesses with each recess receiving one of the first portion of the first fin component, the second portion of the first fin component, the first portion of the second fin component, and the second portion of the second fin component.

9. The projectile of claim 7, wherein the fin mount comprises an abutment disposed adjacent to the plurality of recesses.

10. The projectile of claim 6, wherein the shaft defines a void extending through the rearward end of the shaft, and wherein the fin mount is received by the void to couple the fin mount to the shaft.

11. A projectile for a launching device, comprising:

a shaft having a forward end and a rearward end with the shaft extending therebetween; and a fin mount coupled to the rearward end of the shaft and comprising an extension extending away from the shaft with the extension defining an aperture extending therethrough transverse to the shaft;

wherein the extension has a generally cylindrical configuration; and wherein the aperture is adapted to receive a pin of a launching device for releasably securing the projectile to the launching device.

12. The projectile of claim 11, wherein the extension comprises a ribbing disposed about the extension.

13. The projectile of claim 11, wherein the extension defines a bore extending away from the shaft.

14. The projectile of claim 11, wherein the shaft defines a void extending through the rearward end of the shaft, and wherein the fin mount comprises a base disposed within the void to couple the fin mount to the shaft.

15. The projectile of claim 14 further comprising a first fin component disposed between the shaft and the extension of the fin mount with the first fin component comprising a first portion and a second portion extending transverse to the shaft to opposing first fin distal ends.

16. The projectile of claim 15, wherein the fin mount comprises a body disposed between the base and the extension, and wherein the base and the body define a plurality of recesses with each recess receiving one of the first portion of the first fin component and the second portion of the first fin component.

17. The projectile of claim 16 further comprising a second fin component disposed proximate to the rearward end of the shaft with the second fin component comprising a first portion and a second portion extending transverse to the shaft to opposing second fin distal ends, wherein at least one of the first fin component and the second fin component is adapted to receive the other of the first fin component and the second fin component for securing the first fin component and the second fin component together.

18. The projectile of claim 17, wherein the base and the body define four recesses with each recess receiving one of the first portion of the first fin component, the second portion of the first fin component, the first portion of the second fin component, and the second portion of the second fin component.

19. A projectile for a launching device, comprising:

a shaft having a forward end and a rearward end with the shaft extending therebetween;

a first fin component disposed proximate to the rearward end with the first fin component extending transverse to the shaft to opposing first fin distal ends, wherein the first fin component has a first portion and a second portion defined by the second fin component with the first portion and the second portion extending transverse to the shaft to the opposing first fin distal ends;

a second fin component disposed proximate to the rearward end with the second fin component extending transverse to the shaft to opposing second fin distal ends, wherein the second fin component has a first portion and a second portion defined by the first fin component with the first portion and the second portion extending transverse to the shaft to the opposing second fin distal ends; and a fin mount disposed proximate to the rearward end of the shaft and adjacent to the first fin component and the second fin component, wherein the fin mount cooperates with the shaft to secure the first fin component and the second fin component to the shaft, wherein the fin mount defines a plurality of recesses with each recess receiving one of the first portion of the first fin component, the second portion of the first fin component, the first portion of the second fin component, and the second portion of the second fin component;

wherein at least one of the first fin component and the second fin component engages the other of the first fin component and the second fin component for securing the first fin component and the second fin component together.

* * * * *